US005865637A

United States Patent [19]

Shinozaki et al.

[11] Patent Number: 5,865,637

[45] Date of Patent: Feb. 2, 1999

[54] MOUNTING STRUCTURE OF TERMINAL FITTING

[75] Inventors: Tetsuya Shinozaki; Hiroyuki Matsuoka; Kazuhiko Nimura, all of Yokkaichi, Japan

[73] Assignee: Sumitomo Wiring Systems, Ltd., Japan

[21] Appl. No.: 759,317

[22] Filed: Dec. 2, 1996

[30] Foreign Application Priority Data

| | | | |
|---|---|---|---|
| Dec. 1, 1995 | [JP] | Japan | 7-338223 |
| Dec. 1, 1995 | [JP] | Japan | 7-338224 |
| Dec. 1, 1995 | [JP] | Japan | 7-338225 |

[51] Int. Cl.[6] ..... H01R 13/28

[52] U.S. Cl. ..... 439/287; 439/907

[58] Field of Search ..... 439/290, 284, 439/287, 288, 883, 907

[56] References Cited

U.S. PATENT DOCUMENTS

| | | | |
|---|---|---|---|
| 2,615,736 | 10/1952 | Bergan et al. | 439/287 |
| 2,713,154 | 7/1955 | Bilsborough | 439/287 |
| 2,766,438 | 10/1956 | Kohler et al. | 439/861 |
| 2,968,691 | 1/1961 | Canfield | 174/75 R |
| 3,091,745 | 5/1963 | Williams | 439/223 |
| 3,316,522 | 4/1967 | Demler, Sr. | 439/288 |
| 4,371,230 | 2/1983 | Inoue | 439/849 |
| 4,775,339 | 10/1988 | Sasaki et al. | 439/889 |
| 4,795,380 | 1/1989 | Frantz | 439/860 |
| 4,833,775 | 5/1989 | Nager, Jr. | 29/747 |
| 4,870,722 | 10/1989 | Shell, Jr. | 24/16 R |
| 5,558,531 | 9/1996 | Ikeda et al. | 439/287 |
| 5,586,899 | 12/1996 | Okada | 439/287 |

FOREIGN PATENT DOCUMENTS

| | | |
|---|---|---|
| 2306545 | 10/1975 | France . |
| 63-12543 | 4/1988 | Japan . |
| 370116 | 4/1932 | United Kingdom . |
| 1566554 | 5/1980 | United Kingdom . |

*Primary Examiner*—Neil Abrams
*Assistant Examiner*—Barry M. L. Standig
*Attorney, Agent, or Firm*—Banner & Witcoff, Ltd.

[57] ABSTRACT

Structures are disclosed whereby two or more electrical terminal fittings (10,30) are pressed into tight mutual engagement to ensure a good electrical connection. The invention is especially adapted for earth terminal fittings which are mutually engageable by sliding or rotating movement and which each define an aperture to receive a common mounting stud or screw.

8 Claims, 12 Drawing Sheets

MOUNTING STRUCTURE OF TERMINAL FITTING

FIELD OF INVENTION

The present invention relates to an attachment structure for terminal fittings and particularly to a structure that permits a plurality of electrical terminal fittings to be attached to each other.

BACKGROUND TO THE INVENTION

In the case where a plurality of electrical appliances have individual earth terminals connected separately thereto, and the earth terminals are to be connected to a body or the like, the earth terminals typically are attached in a unified manner by superposing them, and bolts or machine screws are used to fix these to the body. According to this prior structure, the earth terminals are thus engaged tightly with each other so that even those earth terminals which do not make direct contact with the body are indirectly placed in electrical continuity with respect to the body.

However, in the conventional structure, since the fixing together of the earth terminals is carried out by bolts or machine screws, if the bolts or machine screws become loose, there is the danger of deterioration of the continuity of the earth terminals, which then no longer make direct contact with the body.

The present invention has been developed after taking the foregoing circumstances into account, and aims at ensuring that mutual contact between the terminal fittings is reliably maintained.

SUMMARY OF THE INVENTION

According to the invention there is provided a terminal assembly comprising first and second electrical terminal fittings adapted for mutual contact, each terminal fitting having planar superposing members lying over each other in use, and the assembly further comprising pressing structure to press the superposing members into contact with each other.

Preferably each terminal fitting includes a terminal portion having a fixing aperture and said superposing members on either side of said aperture, and a wire connection portion, the wire connection portions of adjacent terminal fittings being substantially in the plane of said superposing members and parallel.

Such terminal fittings are adapted for sliding or rotating engagement, and may include latch members to retain the fittings against disengagement.

The pressing structure may comprise an integral part of one or both of the terminal fittings, or a separate component. Furthermore, the pressing structure may engage the terminal portion of the terminal fitting, or it may engage the wire connection portion. Furthermore, the pressing structure may be defined by a tongue and socket, whereby one of the tongue and socket are resiliently deformable, and the socket presents a slightly undersize aperture to the tongue. In the case where the superposing members are engaged by sliding contact, the socket advantageously comprises a U-shaped integral member of one of the terminal fittings, the tongue engaging within the U-shaped member to ensure that the terminal fittings are pressed into tight neutral engagement.

BRIEF DESCRIPTION OF THE DRAWINGS

Other features of the invention will be apparent from the following description of several preferred embodiments shown with reference to the accompanying drawings in which.

DESCRIPTION OF PREFERRED EMBODIMENT

Figure 1:
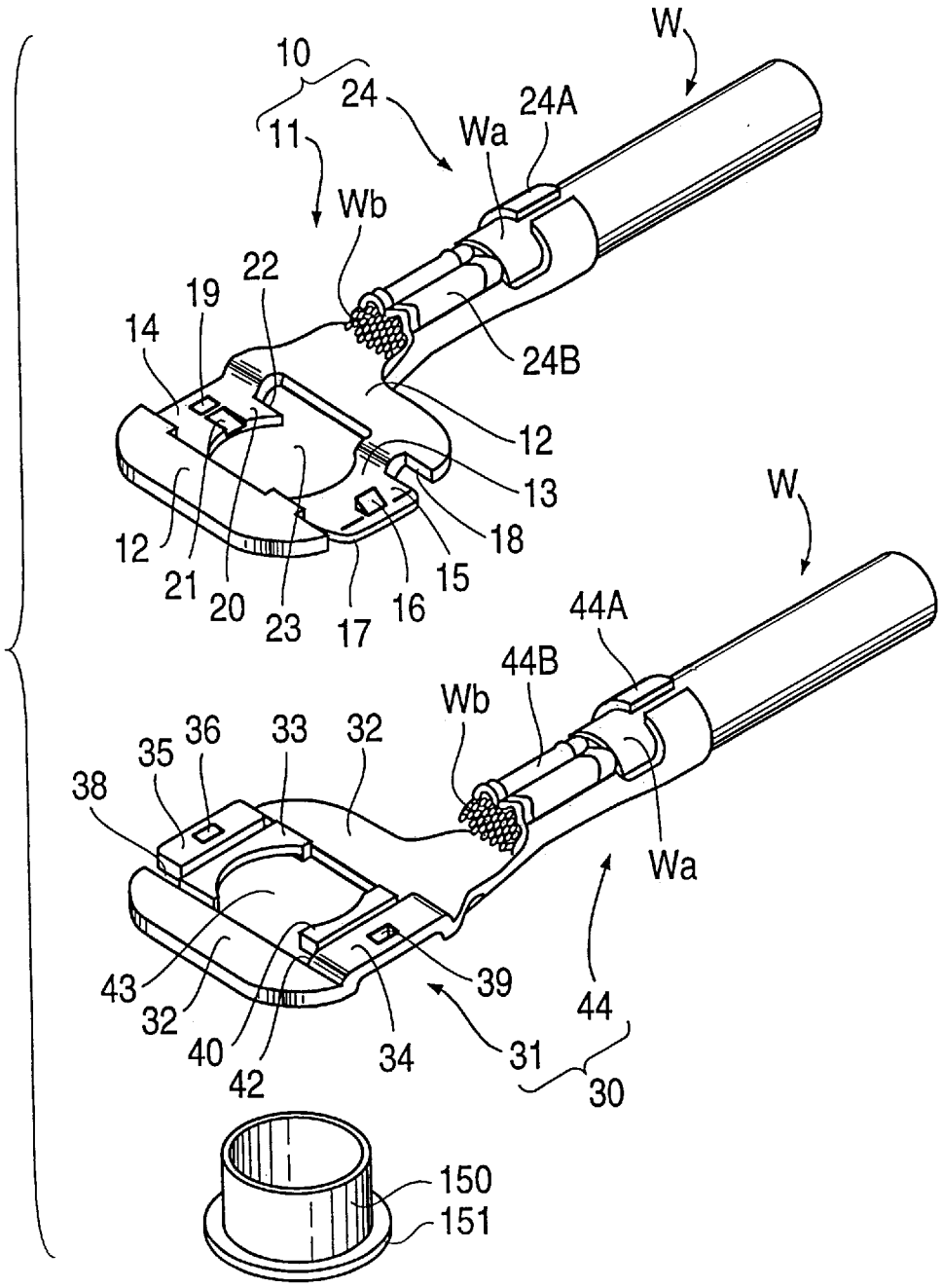
FIG. 1 is a diagonal view of separated terminals according to a first embodiment of the invention.

A first embodiment of the present invention is explained hereinbelow, with reference to FIGS. 1 to 3.

A first terminal fitting 10 is located above a second terminal fitting 30. The first terminal fitting 10 is formed by bending a conductive metal plate punched into a specified shape, and comprises an annular attachment member 11 and an electric wire connecting member 24. The attachment member 11 comprises two flat plate shaped superposing members 12 which extend in a mutually parallel manner with a space formed between them, a plate-like fitting member 13 extending between one end of the superposing members 12; and a plate-shaped receiving member 14 opposite to the fitting member 13 and extending between the other ends of the superposing members 12. Both the superposing members 12 are set to be mutually at the same height, and the fitting member 13 and the receiving member 14 are set so as to be mutually at the same lower height by approximately the thickness of the plate.

The fitting member 13 has a removal preventing member 15 projecting in a planar manner in the direction opposite to the receiving member 14. The upper face of the removal preventing member 15 has a fitting claw 16 formed by partial upward shearing (as viewed). The fitting claw 16 fits into a fitting hole 39, to be described later, of the second terminal fitting 30. The extreme edge of the removal preventing member 15 has an inclined guiding face 17 for facilitating the fitting operation with a receiving member 34, to be described later, of the second terminal fitting 30. A groove 18 is formed between the removal preventing member 15 and the innermost superposing member 12 for allowing the insertion therein of a connecting member of the second terminal fitting 30.

The upper face of the receiving member 14 has a fitting recess or hole 19 formed therein which fits with a fitting claw 36 of the second terminal fitting 30. A protruding member 20 extends towards the removal preventing member 15. The upper face of the protruding member 20 has an inclined guiding face 21 for facilitating the fitting operation with the fitting claw 36 of the second terminal fitting 30. Moreover, a groove 22 is provided between the protruding member 20 and the innermost superposing member 12 in order to allow the insertion of a connecting member of the second terminal fitting 30.

The edges of the fitting member 13 and the protruding member 20 that mutually face each other describe arcs on a common diameter. The side edges of the superposing members 12 are arranged to make contact with the imaginary circle corresponding to the arcs. The space enclosed by these side edges forms a through hole 23 to receive a stud or bolt to be fitted in use.

The connecting member 24 is formed in a unified manner and projects from the extreme side edge of the innermost superposing member 12 in a direction perpendicular to the lengthwise direction thereof. Connecting member 24 comprises an insulation barrel 24A and a wire crimping barrel 24B. The insulation barrel 24A is crimped onto a plastic covering Wa located at the extreme end of an earth wire W coming from an appliance (not shown). The wire barrel Wb is crimped on to an exposed core Wb of the earth wire W, the core Wb being exposed by shaving off the insulation Wa.

The second terminal fitting 30 is formed in the same manner as the first terminal fitting 10, by bending a conductive metal plate punched into a specified shape. The attachment member 31 has a configuration that is the vertical inverse of the attachment member 11 of the first terminal member 10, the plate shaped superposing members 12 of the first terminal fitting 10 being superposed on plate shaped superposing members 32. A fitting member 33 and the receiving member 34 are superposed onto the upper faces of the receiving member 14 and the fitting member 13 respectively of the first terminal fitting 10. As in the case of the first terminal fitting 10, the second terminal fitting 30 also has a removal preventing member 35 and a fitting claw 36 formed on the fitting member 33, and the receiving member 34 has a fitting hole 39 and a protruding member 40 formed thereon as illustrated. The through hole 43 interfaces with through hole 23 and grooves 38 and 42 are formed respectively between the removal preventing member 35 and the innermost superposing member 32, and the protruding member 40 and the innermost superposing member 32.

The electric wire connecting member 44 comprises an insulation barrel 44A and a wire barrel 44B, and has an earth wire W crimped thereon. The wire connecting members 24, 44 extend from opposite sides as illustrated. Consequently, when the second terminal fitting 30 is fitted with the first terminal fitting 10, the wire connecting members extend parallel to each other.

The attachment sequence of the first and the second terminal fitting 30 as follows. The first terminal fitting 10 is positioned above the second terminal fitting 30 and the respective fitting members 13 and 33 thereof are inserted into corresponding through holes 43 and 23. From this state, the through holes 23 and 43 are slid transversely into register (hereinafter referred to as the attachment direction) so as to mutually interface. When this is done, simultaneously with the removal preventing member 15 of the first terminal fitting 10 sliding under the receiving member 34 of the second terminal fitting 30, the removal preventing member 35 of the second terminal fitting 30 slides above the receiving member 14 of the first terminal fitting 10, and when the fitting claws 16 and 36 fit with the fitting holes 19 and 39, the attachment of the terminal fittings 10 and 30 is completed. In this state, due to the engagement of the fitting claws 16 and 36 with the fitting holes 19 and 39, separation in the direction opposite to the attachment direction is controlled. Along with this, excessive movement in the attachment direction is prevented due to the contact established by the interior extreme ends of the grooves 18 and 42 on the one hand, and 22 and 38 on the other. Moreover, separation in the up-down direction is controlled by the fitting of the plate shaped superposing members 12 and 32, and of the fitting members 13 and 33.

Next, the configuration required for retaining the terminal fittings 10 and 30 in a fitted state is explained. In the present embodiment, a metal tubular body 150 that is independent of the terminal fittings 10 and 30 is used as a supporting means. The tubular body 150 is formed in the manner of a hollow rivet and is insertable into the through holes 23 and 43 with a close fit. Its length in the axial direction is larger than the sum of the thicknesses of the plate shaped superposing members 12 and 32.

Figure 2:
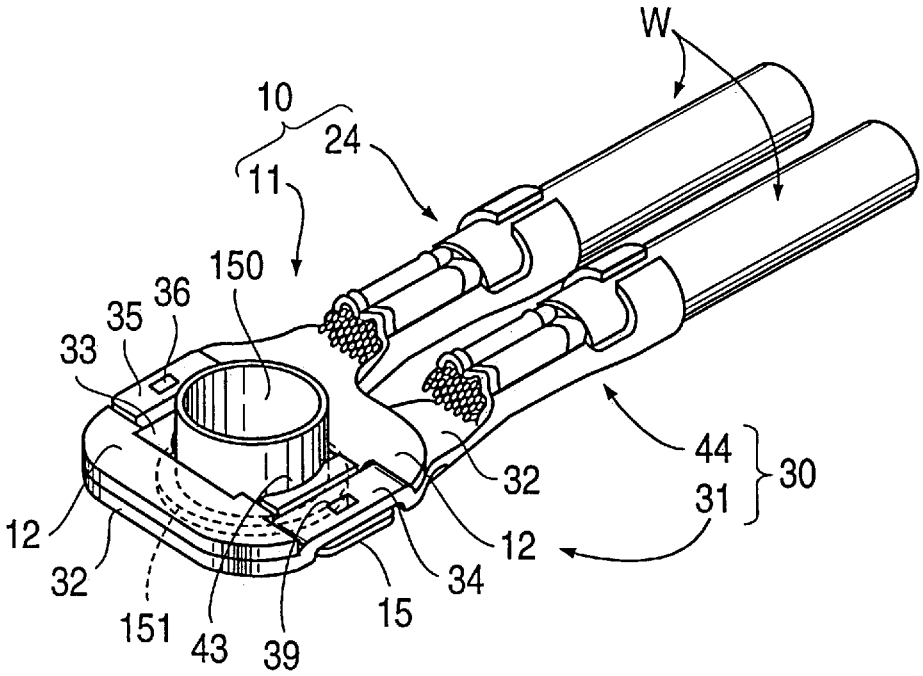
FIG. 2 is a diagonal view showing the terminal of FIG. 1 in an attached state.
Figure 3:
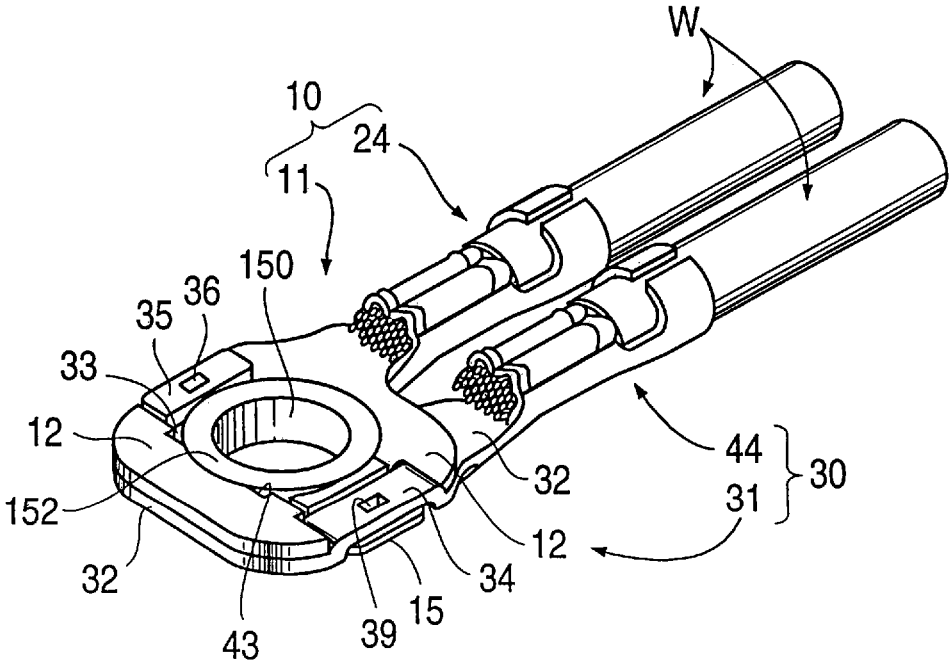
FIG. 3 is a diagonal view showing the terminals of FIG. 1 in a completed state.

The tubular body 150 is in use inserted from below into the through holes 23 and 43, and the fitting flange 151 engages the lower hole edge (FIG. 2). The protruding upper portion is rivetted over using pressure operation of a jig (not shown) to form a flange 152 (FIG. 3).

In this manner, the superposing members 12 and 32 are firmly clamped together by means of the tubular body 150, and a highly reliable contact is achieved between the two terminal fittings 10 and 30.

Figure 4:
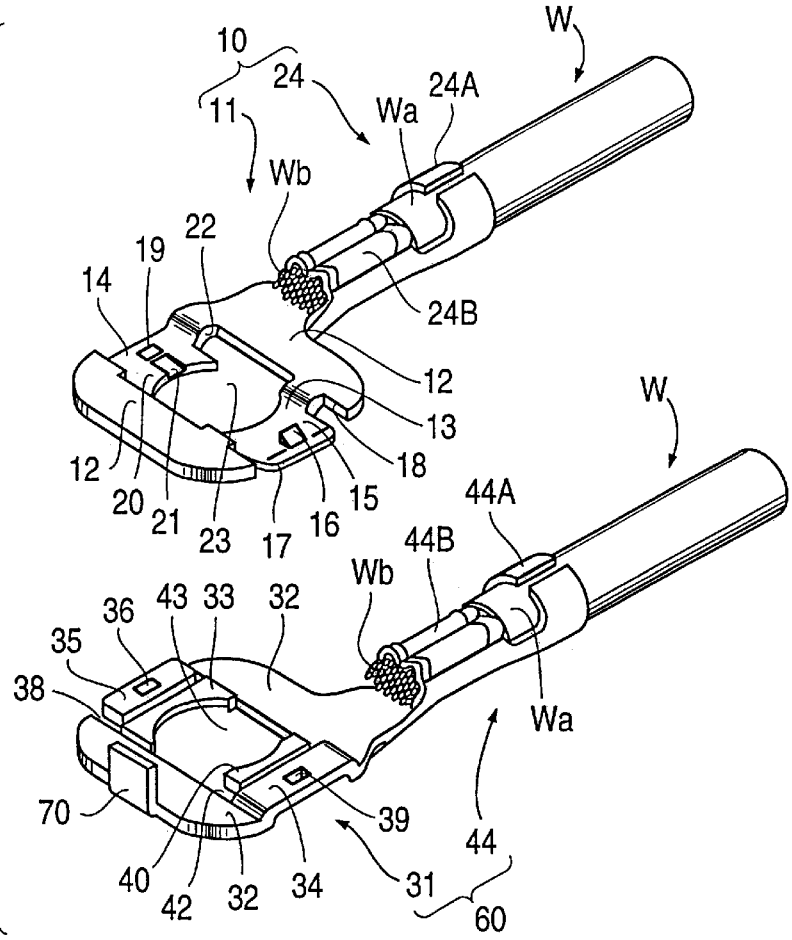
FIG. 4 is a diagonal view of separated terminals according to a second embodiment of the invention.

In the second embodiment (FIGS. 4 and 5), a supporting means for supporting a first terminal fitting and a second terminal fitting is provided on the second terminal fitting. The first terminal fitting is the same as described in the first embodiment, and the second terminal fitting is the same as the one described in the first embodiment, apart from the supporting means. Consequently, the same numerals are accorded to various parts and descriptions of the structure, operation and effects thereof are omitted.

A second terminal fitting 60 of the second embodiment has a plate-shaped fixing member (supporting means) 70 formed in a uniform manner and extending in an upward direction from the outer edge of the outermost superposing member 32. This fixing member 70 has a dimension sufficiently greater than the thickness of a first terminal fitting 10.

Figure 5:
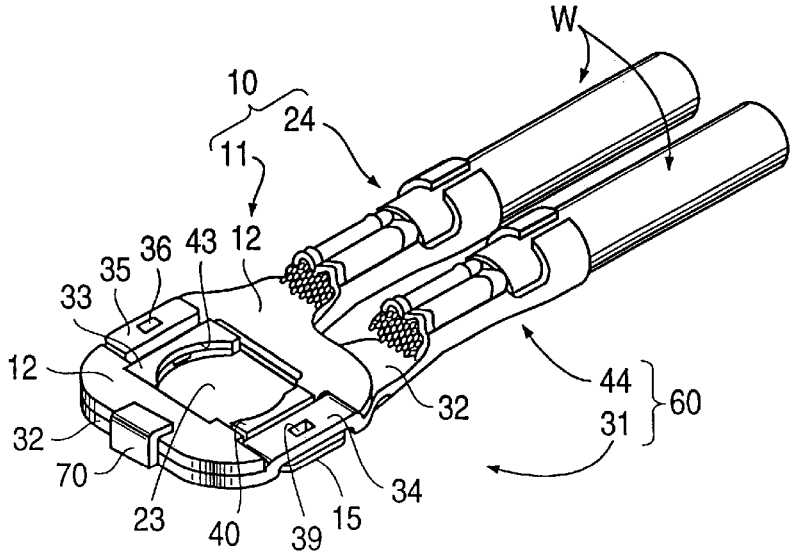
FIG. 5 is a diagonal view showing complete attachment of the terminals of FIG. 4.
Figure 6:
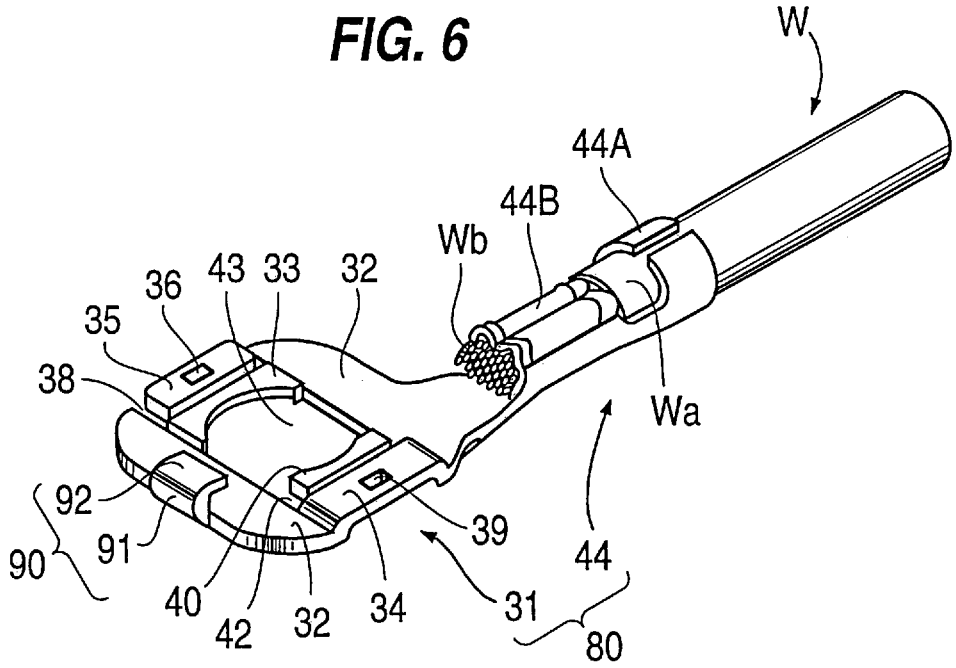
FIG. 6 is a diagonal view of a second terminal of a third embodiment.
Figure 7:
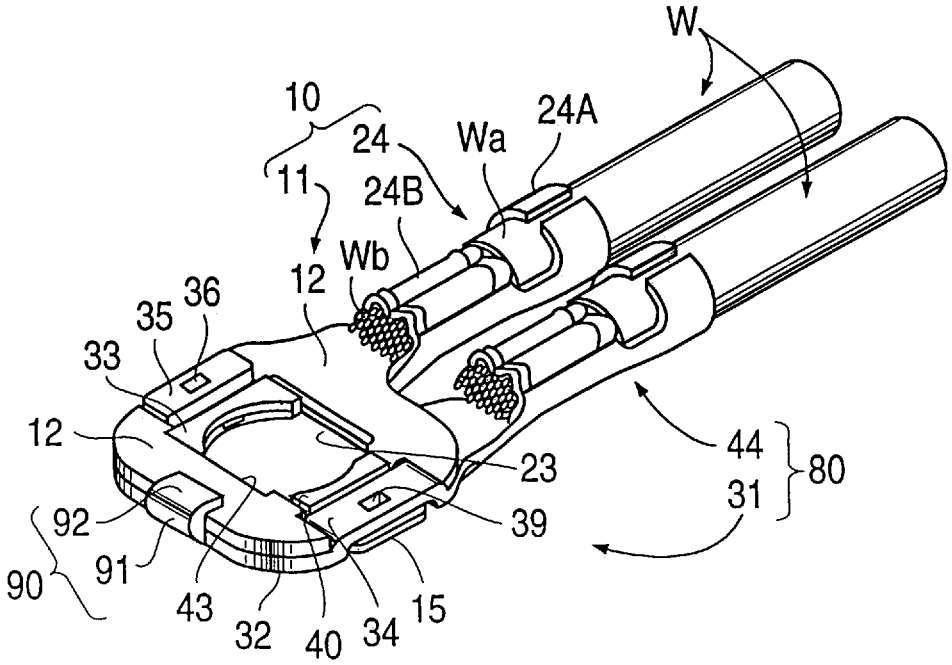
FIG. 7 is a diagonal view showing complete attachment of the third embodiment.

The fixing member 70 is bent inward after the first terminal fitting 10 and the second terminal fitting 60 are in an attached state, and, as shown in FIG. 5, is crimped over the first terminal fitting 10.

Accordingly, the terminal fittings 10, 60 are firmly fixed together by means of the fixing member 70 and a highly reliable connection is achieved.

In the third embodiment (FIGS. 6–10), although a supporting means for supporting a first terminal fitting and a second terminal fitting is provided on the second terminal fitting, the configuration thereof differs from that of the second embodiment. The first terminal fitting is the same embodiment as described previously, and the second terminal fitting is the same as that previously described apart from the supporting means. Consequently, the same numerals are accorded to various parts, and descriptions of the structure, operation and effects thereof are omitted.

Figure 8:
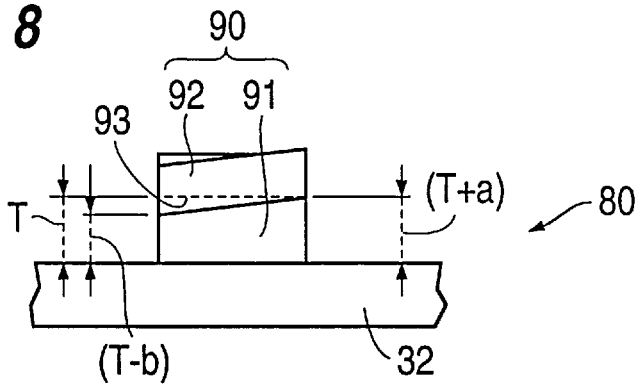
FIG. 8 is a partially enlarged view showing the setting of the dimensions for the third embodiment.
Figure 9:
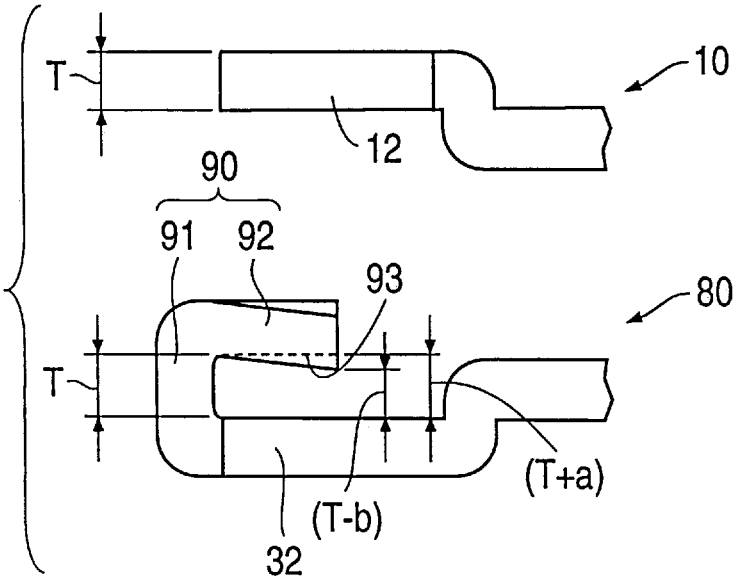
FIG. 9 is a partially enlarged view in the separated state showing the setting of the dimensions of the third embodiment.
Figure 10:
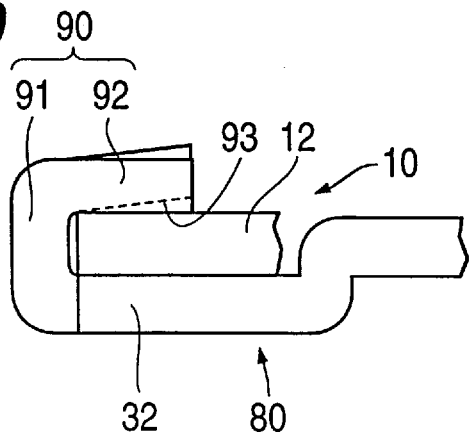
FIG. 10 is a partially enlarged side face view of the attached state of the third embodiment.

A second terminal fitting 80 of the third embodiment has a plate-shaped fixing member (supporting means) 90 formed in a uniform manner so as to extend in an upward direction from the outer edge of the outermost superposing member 32, and the upper edge of a rising member 91 additionally bends inward in an overhanging manner. The space between the lower face of this overhanging clamping pressure member 92 and the upper face of the superposing member 32 is not constant: the anterior edge of the lower face of the clamping pressure member 92 is arranged to incline downwards. Further, as shown in FIG. 8 and FIG. 9, the length of the rising member 91, constituting a connecting member, the same as a thickness T of the first terminal member 10. Moreover, the space below the extreme anterior edge of the clamping pressure member 92 is not fixed along the direction of the edge. The space under the end portion (in FIG. 8, the right side), from where the plate shaped superposing member 12 of the first terminal member 10 enters, is greater (T+a) than the plate thickness; and the space under the end portion opposite to the one mentioned above is less (T−b) than the thickness of the superposing member 12. Further, between these end portions, the lower face of the pressure clamping member 92 forms an inclining guiding face 93 for facilitating the insertion operation of the superposing member 12 of the first terminal fitting 10.

When the first terminal fitting 10 and the second terminal fitting 80 are assembled, the plate shaped superposing member 12 of the first terminal fitting 10 is inserted so as to enter under the clamping pressure member 92. Here, since the space under the end portion towards the insertion side is greater than the plate thickness T of the plate shaped superposing member 12, there is no possibility of the entry of the plate shaped superposing member 12 being adversely affected. Furthermore, since the lower face of the clamping pressure member 92 constitutes the inclining guiding face 93 in the insertion direction of the plate shaped superposing member 12, the insertion operation is carried out smoothly. After the insertion has proceeded to a certain extent, the fixing member 90 bends elastically so that the clamping pressure member 92 opens upwards. In the state where the insertion operation of the superposing member 12 is complete, due to the elastic recovery force of the fixing member 90 the superposing member 12 of the first terminal fitting 10 is elastically clamped between the superposing member 32 of the second terminal fitting 80. Accordingly, the superposing members are firmly fixed together and a highly reliable connection is achieved between the terminal fittings 10 and 80.

Figure 11:
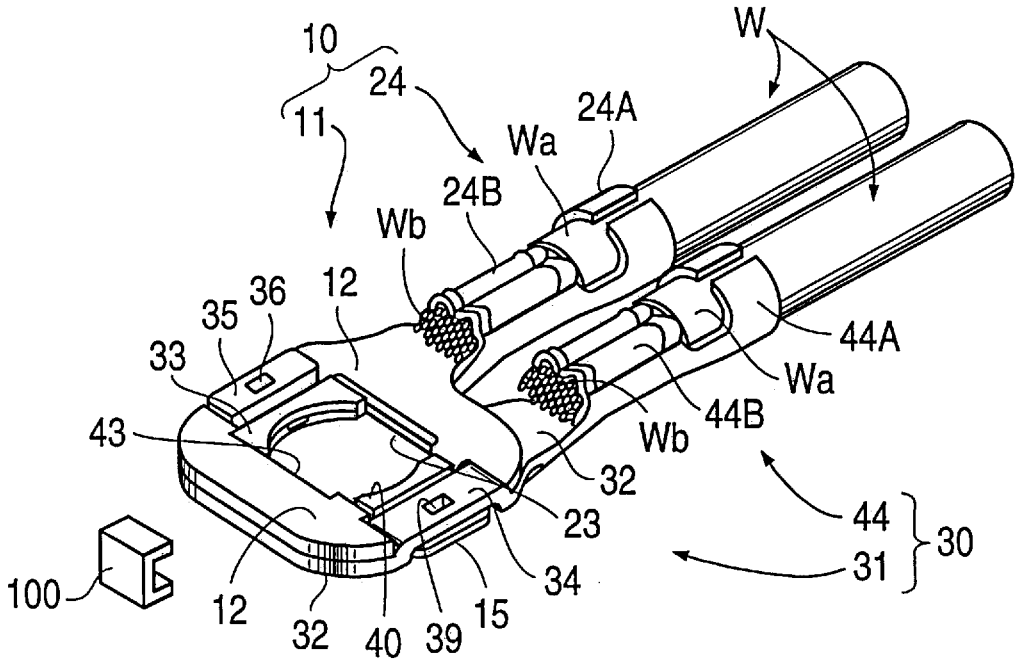
FIG. 11 is a diagonal view of a fourth embodiment showing an intermediate state during attachment.
Figure 12:
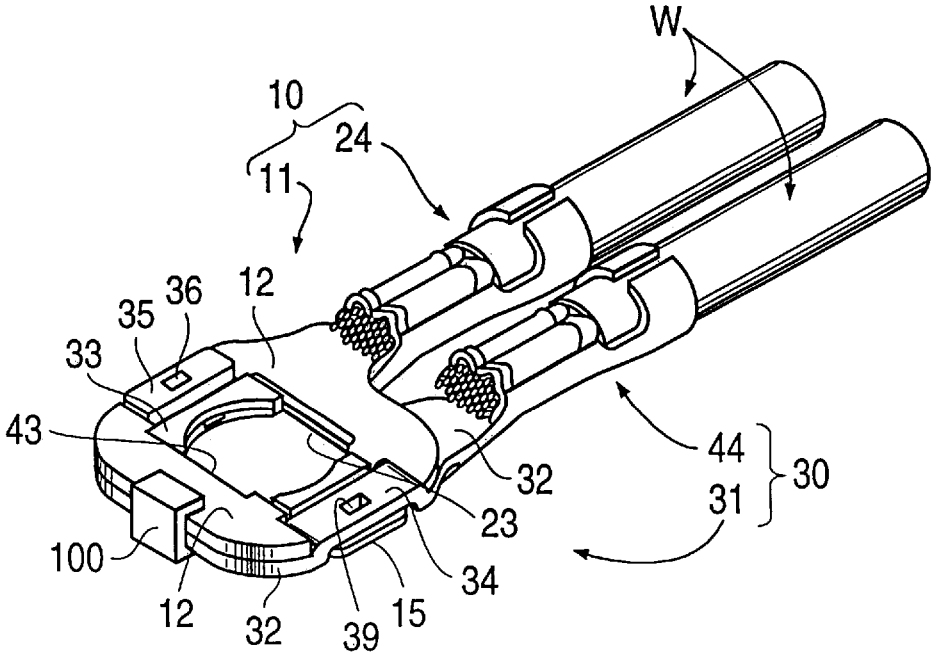
FIG. 12 is a diagonal view of the fourth embodiment showing a state whereby the attachment is completed.

The fourth embodiment (FIGS. 11 and 12) is similar to the first embodiment in that a supporting means is provided independently of the first terminal fitting and the second terminal fitting. The configurations of the first terminal fitting and the second terminal fitting are the same as that of the first embodiment. Accordingly, the same numerals are accorded to the same configuration, and descriptions of the structure, operation and effects thereof are omitted.

The supporting means of the fourth embodiment comprises a C-shaped supporting member 100 made from metal material. Superposed plate shaped superposing members 12 and 32 are arranged to be clamped by the supporting means 100.

The supporting means 100 is attached to the external edge portion of one of the plate shaped superposing members 12 and 32 when a first terminal fitting 10 and a second terminal fitting 30 are in an attached state. The supporting means 100 is crimped in an up-down direction by means of a jig (not shown). As a result, the plate shaped superposing members 12 and 32 are fitted together firmly and a highly reliable connection is achieved between the terminal fittings 10 and 30.

A fifth embodiment of the invention is now explained with reference to FIGS. 13 and 14. The terminal fittings 10 and 30 are identical to those illustrated in the first embodiment, and are assembled in the same manner.

Further description is not required.

Figure 13:
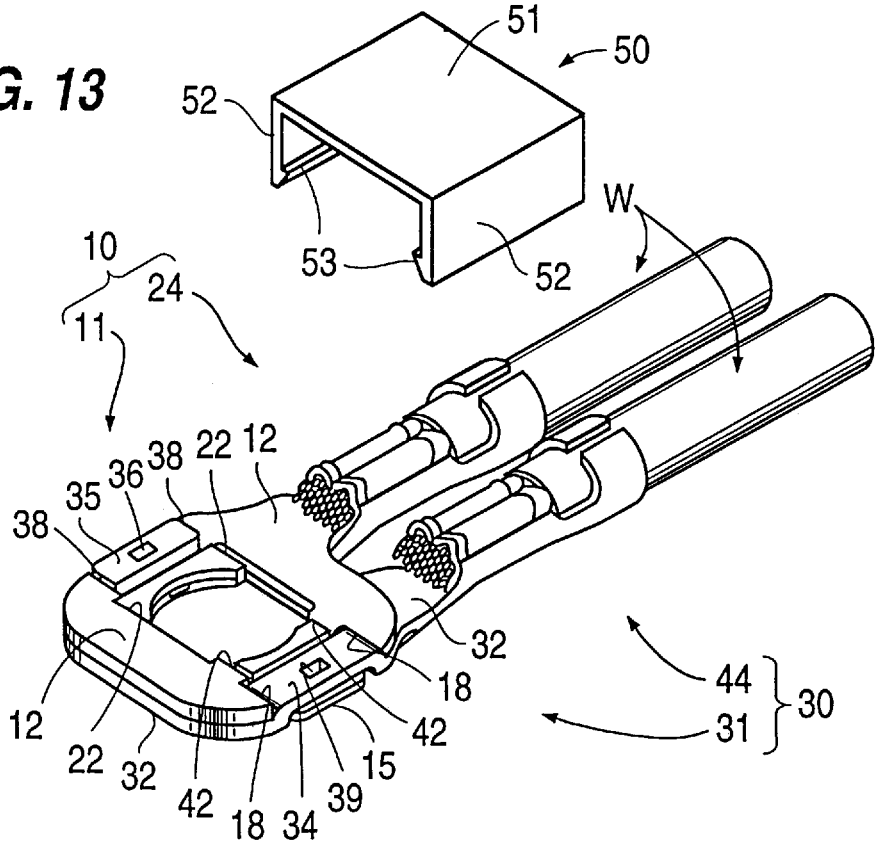
FIG. 13 is a diagonal view of a fifth embodiment in a partially attached state.

As illustrated in FIG. 13 a supporting member 50 that is independent of the terminal fittings 10 and 30 is used as a supporting means. This supporting member comprises a generally rectangular planar plate member 51 with opposite depending side wall members 52. The sidewall members are bendable, and typically the supporting member 50 is made of a resilient plastics material or of metal. The space between the sidewall 52 is slightly less than the distance between the wire connecting members 24, 44, and longitudinal inwardly extending lugs 53 are provided at the lower edge of the sidewalls 52.

Figure 14:
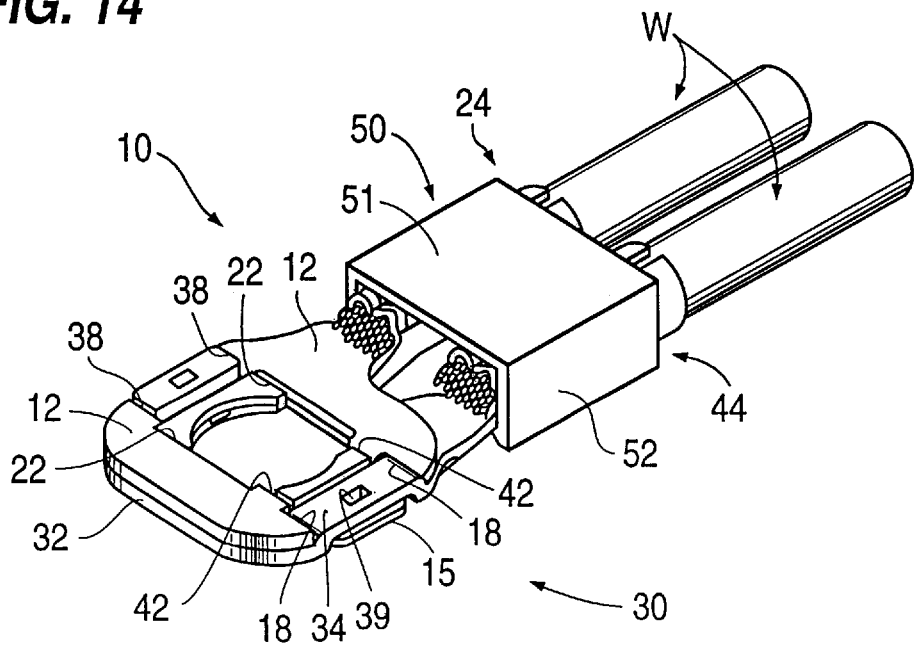
FIG. 14 is a view of the fifth embodiment with a cover attached.

As illustrated in FIG. 14 the supporting member is snapped over the connecting members 24,44 to hold them firmly together. The elastic recovery force of the sidewalls 52 urges the connecting members 24,44 in the attachment direction, and thus a highly reliable secondary support is provided. The lugs 53 hold the supporting member 50 against inadvertent upward removal.

A sixth embodiment of invention is illustrated with reference to FIGS. 15 and 16.

Figure 15:
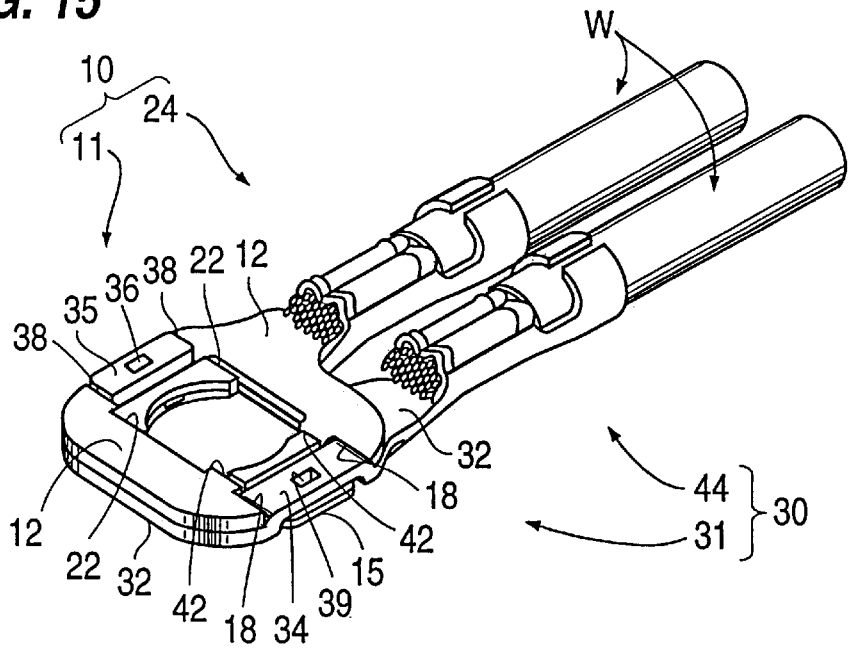
FIG. 15 is a diagonal view of a sixth embodiment in a partially connected state.

FIG. 15 illustrates a pair of connected terminal fittings 10,30 of the same type as illustrated with respect to the first embodiment; further description is not necessary.

Figure 16:
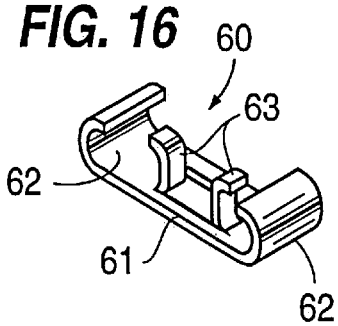
FIG. 16 is a diagonal view of a connecting member.

FIG. 16 illustrates a supporting member 60 bent out of metal and having a generally rectangular base 61 with upstanding opposite sidewalls 62. A pair of upstanding claws 63 are sheared out of the base 61. As illustrated each adjacent end wall 62 and claw 63 are bent towards each other to define two generally C-shaped enclosures; the internal width dimension of these each enclosure being positioned and set to receive the wire connecting members 24,44.

Figure 17:
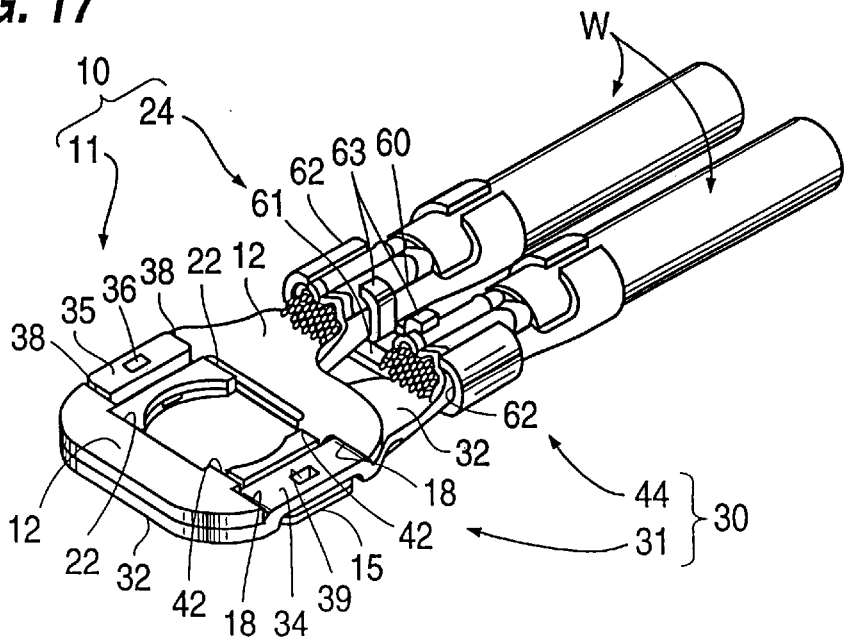
FIG. 17 is a view of the terminal of FIG. 15 in a fully connected state.

As illustrated in FIG. 17 the supporting member 60 is fixed from below after the first and second terminal fittings 10, 30 have been attached. The respective connecting members 24,44 snap into the respective enclosures, and are held resiliently by the respective end walls 62 and claw members 63. The distance between an end wall 62 and claw 63 is preferably slightly less than the width of a connecting member. Furthermore, since the superposing members 12 and installation barrels 24A, 44A are wider than the wire barrels 24B, 44B, the supporting member is restrained against displacement in the axial direction of the wires. The supporting member 60 also assists in maintaining electrical continuity between the terminals, and reliability is thus further increased.

Figure 19:
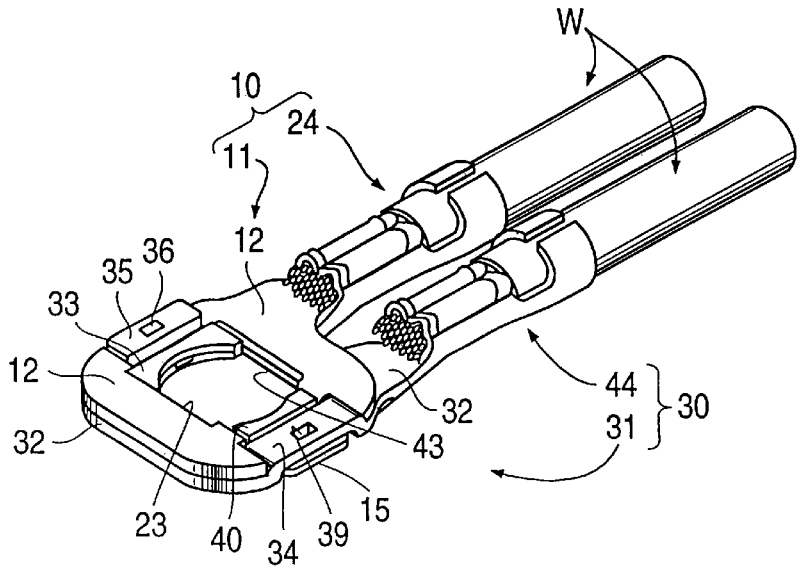
FIG. 19 is a diagonal view of the seventh embodiment in a fully connected state.
Figure 20:
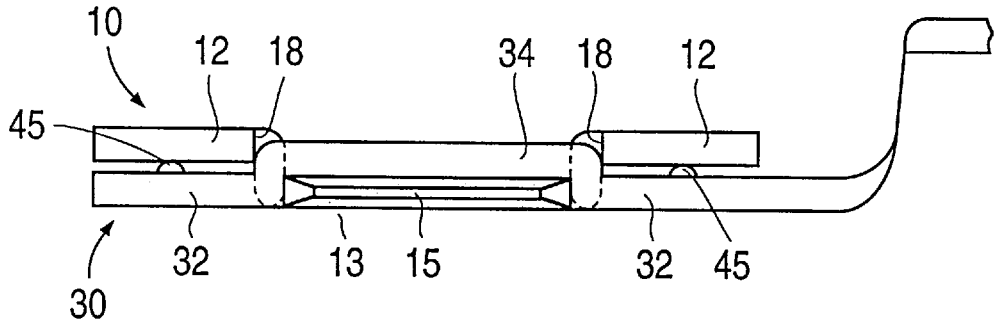
FIG. 20 is a partially enlarged side face view of the attached state of the seventh embodiment.

A seventh embodiment of the invention is described with reference to FIGS. 18 to 20. The upper and lower terminal fittings of FIG. 18 are as previously described, and similar parts carry the same reference numerals.

Figure 18:
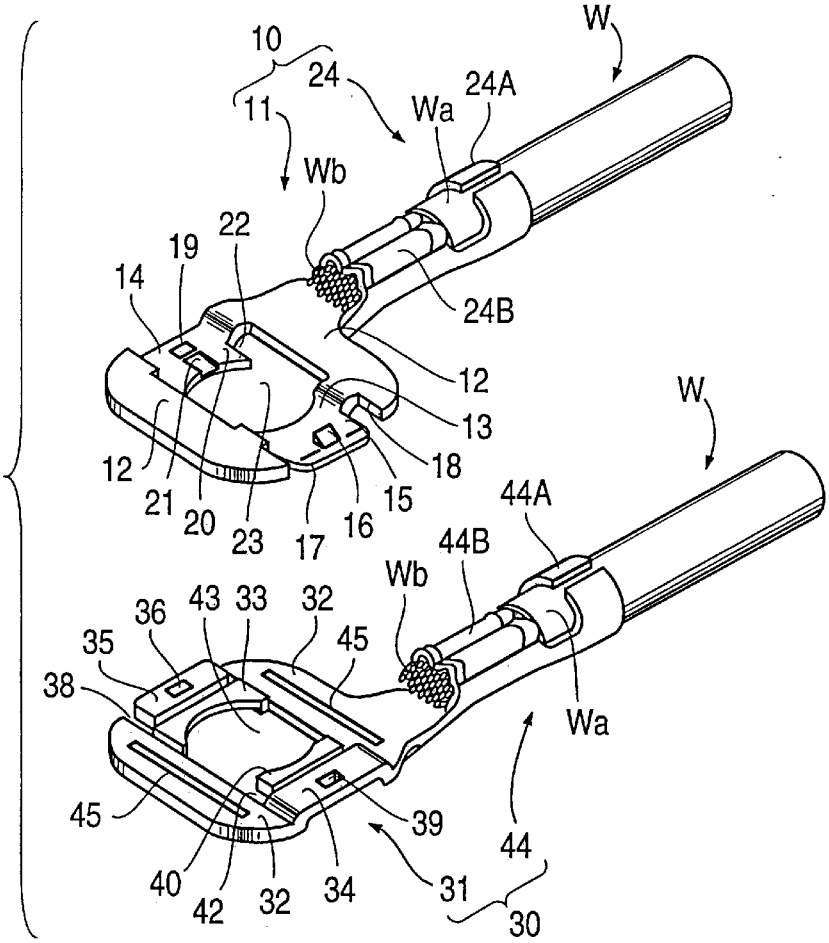
FIG. 18 is a diagonal view of separated terminals according to a seventh embodiment of the invention.

As illustrated in FIG. 18 the lower terminal fitting 30 has narrow upstanding ribs 45 extending longitudinally along each of the superposing members 32. These ribs are pressed from below, and as illustrated in FIG. 20 they urge the terminal fittings 10,30 slightly apart so as to ensure a firm and reliable electrical contact. An advantage of aligning the ribs across the terminal is that the frictional force during attachment of the terminal fittings 10,30 is kept to a minimum. The ribs 45 maintain the terminal fittings under a resilient load.

Figure 21:
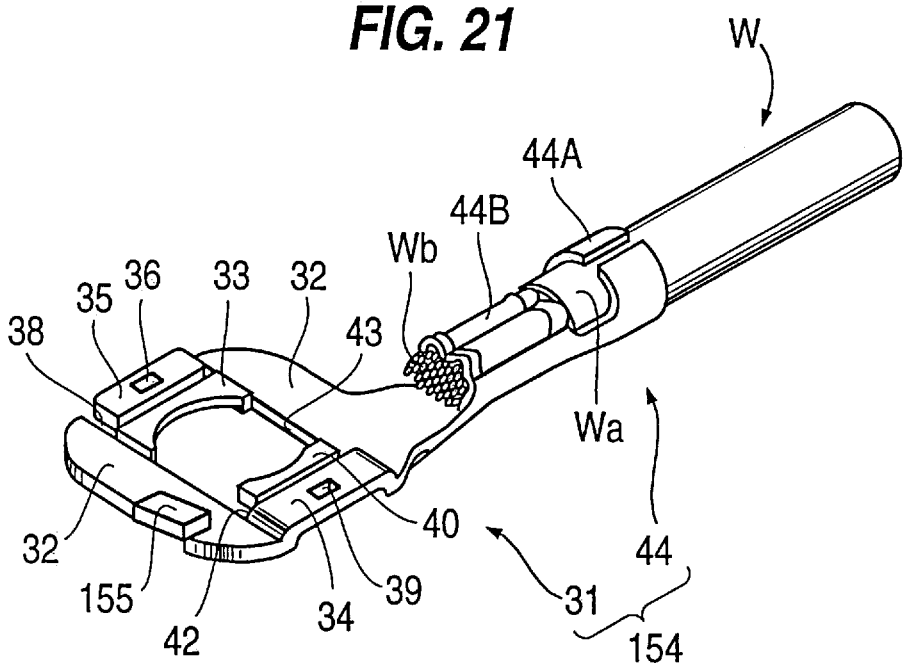
FIG. 21 is a diagonal view of a lower terminal of an eighth embodiment of the invention.
Figure 22:
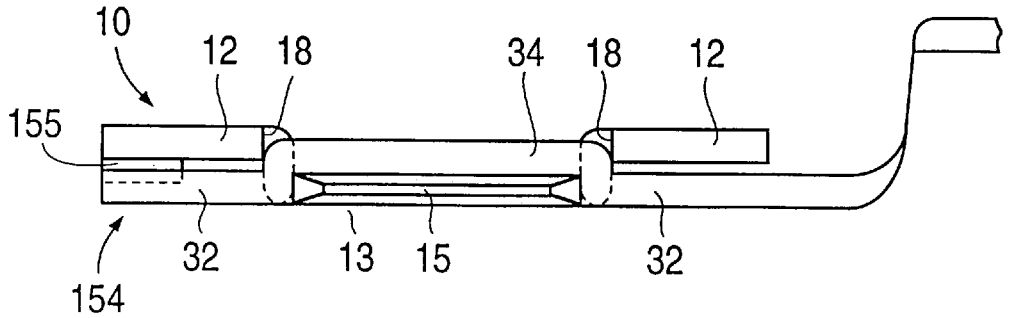
FIG. 22 is a partially enlarged side view of the eighth embodiment in a fully connected state.
Figure 23:
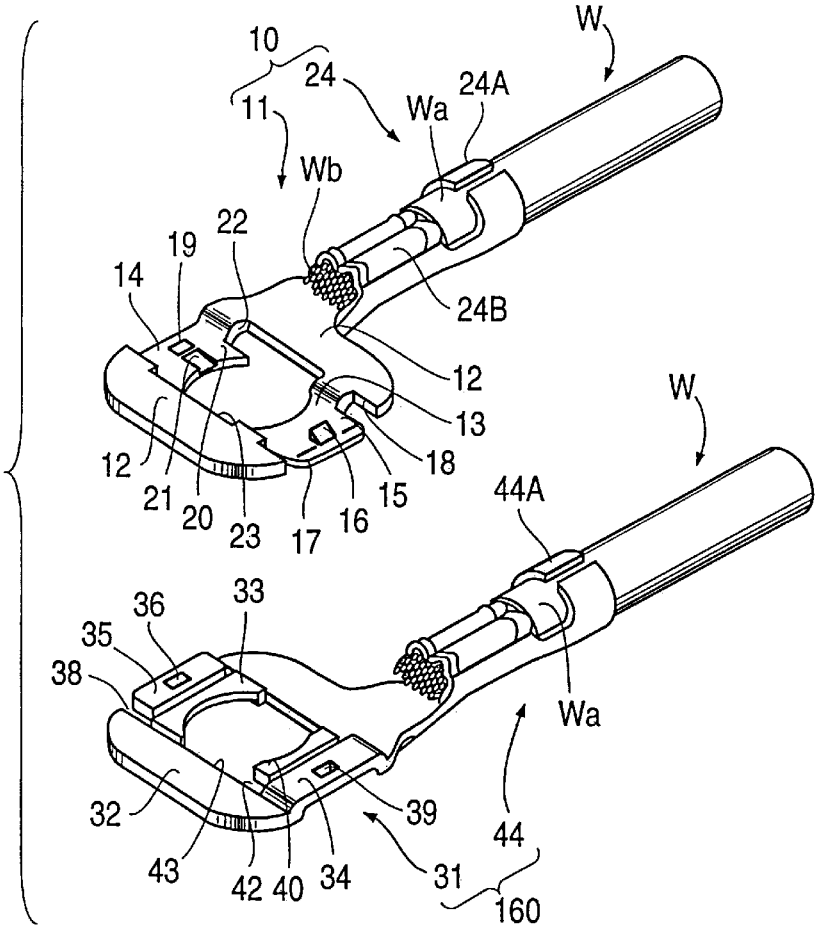
FIG. 23 is a diagonal view of separated terminals according to a ninth embodiment of the invention.
Figure 24:
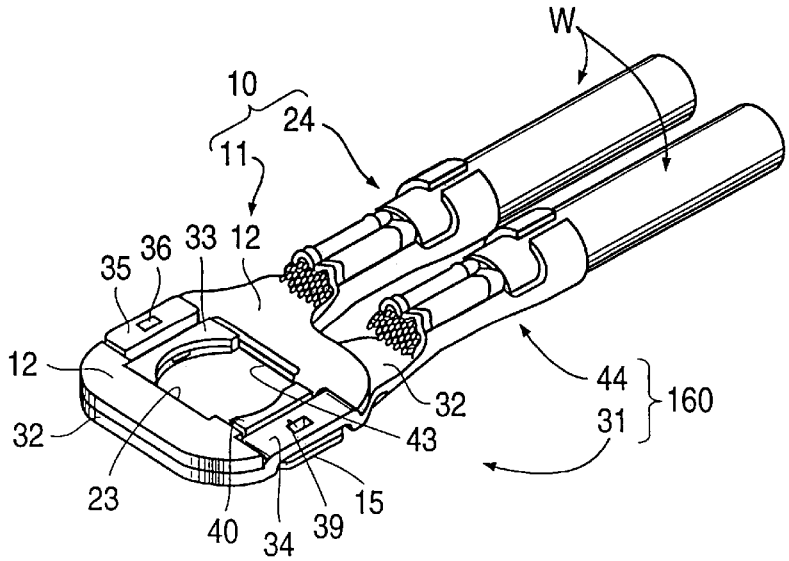
FIG. 24 is a diagonal view of the ninth embodiment in a fully connected state.

An eighth embodiment of the invention is illustrated in FIGS. 21 and 22. The upper terminal is as illustrated in FIG. 18, and further description is not required. The lower terminal 154 is similar to that described in FIG. 18, except that the longitudinal ribs 45 are omitted. The outermost superposing member 32 has a tongue sheared out from the plane of the terminal fitting, and bent upwards at a slight angle, as illustrated. The maximum height of the cut-away member 155 is greater than the height of the lower face of the upper terminal fitting 10 so that the fittings are urged slightly apart on being slid together. This ensures a good and reliable electrical contact.

As illustrated in FIG. 21 the incline of cut-away member 155 faces in the attachment direction so as to permit smooth engagement of the terminals. The end of the cut-away member 155 tends to dig into the superposing member of the upper terminal, so as to inhibit disassembly of the terminals.

A ninth embodiment is described with reference to FIGS. 23 to 26.

The upper and lower terminals 10,160, are substantially as previous described, and further description of common parts is not necessary. Neither the ribs 45, nor the cut-away member 155 are provided in the lower terminal fitting 160.

The terminals are slid together in the manner already described.

Figure 25:
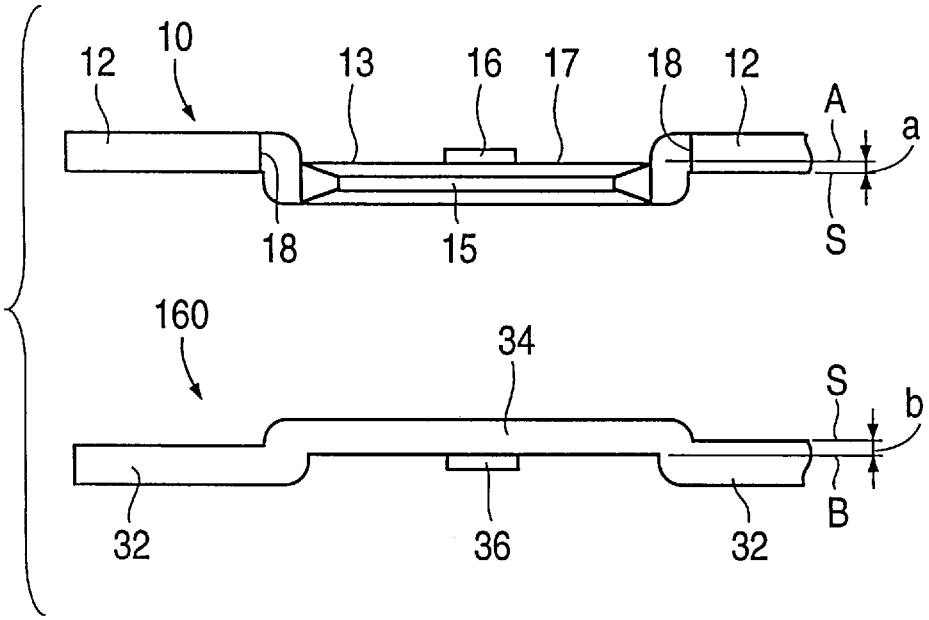
FIG. 25 is a partially enlarged side view of the ninth embodiment in a separated state.
Figure 26:
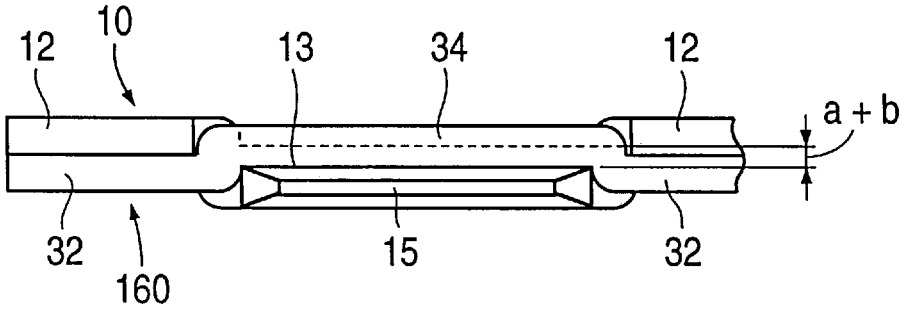
FIG. 26 is a partially enlarged side view of the ninth embodiment in a fully connected state.

Certain critical dimensions of the terminals are however different, as illustrated in FIGS. 25 and 26. As shown in FIG. 25, in the upper terminal fitting 10, the height A of the upper face of a removal preventing member 15 (the face with which the lower face of the receiving member of the lower terminal fitting makes contact) is set to be greater by a than the height S of the lower face of the plate-shaped superposing member 12 (the face that makes contact with the upper face of a plate-shaped superposing member 32 of the lower terminal fitting 160).

In the lower terminal fitting 160, the height B of the lower face of a receiving member 34 is set to be lower by b than the height S of the upper face of the plate-shaped superposing member 32. In other words in the state where the plate-shaped superposing members 12,32 of the terminal fittings 10,160 are firmly fixed together at height S, the height A of the upper face of the removal preventing member 15 of the upper terminal fitting 10 is set to be lower than the height B of the lower face of the receiving member 34 of the lower terminal fitting 160.

In order to fit the corresponding terminal fitting a space (of dimension +b) below the standard height S is necessary. The dimension for allowing fitting of the removal preventing member 15 is set to be below the standard height S by (−a). That is the dimension for allowing fitting is set to be smaller than the required dimension by only (b−(−a)) which equals (a+b).

Furthermore, although not shown, the same dimension settings are arranged for the height relationship in the first terminal fitting 10 of the receiving member 14 with respect to the plate-shaped superposing member 12, and for the height relationship in the second terminal fitting 160 of the removal preventing 35 with respect to the plate-shaped superposing member 32.

When the first terminal fitting 10 and the second terminal fitting 160 are attached together, due to its bending resilience, the removal preventing member 15 goes under the receiving member 34. At this point the relative bending of the removal preventing member 15 is (a+b) with respect to receiving member 34, and to that extent the dimension for allowing fitting of the removal preventing member 15 increases. Moreover, the removal preventing member 35 of the second terminal fitting 60 also fits with the receiving member 14 of the first terminal fitting 10 due to resilient bending in the same way as described above. In the attached state, the terminals thus fit strongly with each other due to the resilient recovery force in the removal preventing members 15,35. This ensures a highly reliable contact between the terminals.

The present invention is not limited to the embodiments described above with the aid of figures. For example, the possibilities described below also lie within the technical range of the present invention. Moreover, the present invention may be embodied in various ways other than those described below without deviating from the scope thereof.

(1) Although in the second embodiment the fixing member in the state preceding its bending is formed to rise upwards perpendicularly from the plate shaped superposing member, it may equally be arranged to protrude in the same plane as the superposing member.

(2) Although in the second and third embodiments the fixing member is shown as being provided only in the second terminal fitting, the fixing member may equally be provided on the first terminal fitting, or on both the first terminal fitting and the second terminal fitting.

(3) In the second and third embodiment, although the fixing member is shown as being provided on the external edge portion of one of the plate shaped superposing members, the location for providing the fixing member can be elsewhere, such as the edge of the through hole Moreover, a plurality of fixing members may equally be provided.

(4) In the fourth embodiment, although the supporting member is attached by crimping, the configuration can equally be such that the supporting member has the same shape but is resiliently attached. In this case, the superposing members are pressed down by the elastic recovery force of the supporting member. Further, in the case where attachment is carried out elastically as described, the removal of the supporting member can be prevented by arranging a convex member on the inner side of the anterior edge of the supporting member, this convex member being made to fit with a concave member formed on the superposing member.

(5) In the above embodiments, an attachment type arrangement is described where the terminal fitting is attached by sliding it along the plate face of the superposing member. However, the present invention can also apply in the case where attachment is carried out by relative rotation with the through hole as centre, in the state where the bolt through holes are aligned.

(6) In the above embodiments, a case where two terminal fittings are attached is explained. However, the present invention is also applicable in the case where three or more terminal fittings are attached. In the above embodiments, a case is also described where the embodiments apply to terminal fittings used for earthing. However, the present invention can also apply to terminal fittings used for other purposes.

(7) In the fifth and sixth embodiments the inwardly projecting portions of the supporting members may be cut out of the respective sidewall rather than being provided by a bent or moulded portion.

(8) It is also possible in the fifth and sixth embodiments for the supporting member to clamp the terminals in the up and dow n direction rather than laterally.

In the case of the sixth embodiment, the longitudinal rim may be replaced by a dimple, or a plurality of aligned dimples. Furthermore, the protrusions may be provided on one or other or both of the terminal fittings.

In the case of the seventh embodiments a single resilient cut-away member is provided, several such members could however be provided, and at different locations on either the upper or lower terminal fitting. A plurality of cut-away members will increase stability of the terminal.

In the ninth embodiment it is disclosed that in the first terminal fitting, the upper face of the removal preventing member is higher than the lower face of plate-shaped superposing member, and in the second terminal fitting the lower face of the receiving member is lower than the upper face of the plate-shaped superposing member. However, the relationship between these faces is not limited. For example, in the second terminal fitting the lower face of the receiving member can be set higher than the upper face of the plate-shaped superposing member, and this difference in height can be set to be less than the difference in height in the first terminal fitting between the upper face of the removal preventing member and the lower face of the plate-shaped superposing member. What is required is that when the terminal fittings are attached, the co-operating parts are placed under a resilient load so as to ensure good electrical continuity.

We claim:

1. A terminal assembly comprising first and second electrical terminal fittings adapted for mutual contact, each terminal fitting including planar superposing members lying over each other in use, a terminal portion having a fixing aperture, said superposing members being on either side of said aperture, and a wire connection portion, the wire connection portions of adjacent terminal fittings being substantially in the plane of said superposing members and parallel, the assembly further comprising pressing structure to press the superposing members into contact with each other, said pressing structure comprising a clamping member having a first portion extending upwardly from one of the superposing members of one of said terminal fittings and a second portion extending over said one superposing member, said second portion being substantially at right angles to the first portion and lying at an acute angle to the plane of said one superposing member so as to present a tapered mouth, the second portion being spaced from the one superposing member by a distance which decreases from more than the thickness of one of the superposing members of the second terminal to less than said thickness.

2. A terminal assembly comprising first and second electrical terminal fittings adapted for mutual contact, each terminal fitting including planar superposing members lying over each other in use, a terminal portion having a fixing aperture, said superposing members being on either side of said aperture, and a wire connection portion, the wire connection portions of adjacent terminal fittings being substantially in the plane of said superposing members and parallel, the assembly further comprising pressing structure to press the superposing members into contact with each other, said pressing structure comprising a C-shaped member having opposite arms spaced apart slightly more than adjacent superposing members of said terminal fittings, and being adapted to be clenched over said terminal fittings to secure the terminal fittings together.

3. A terminal assembly comprising first and second electrical terminal fittings adapted for mutual contact, each terminal fitting including planar superposing members lying over each other in use, a terminal portion having a fixing aperture, said superposing members being on either side of said aperture, and a wire connection portion, the wire connection portions of adjacent terminal fittings being substantially in the plane of said superposing members and parallel, the assembly further comprising pressing structure to press the superposing members into contact with each other, said pressing member comprising a resilient clip having a base and two depending legs, said legs having oppositely directed flanges whereby said clip is adapted to be placed over said wire connection portions in use, the base engaging one side of said wire connection portions and the flanges engaging the other side of said wire connection portions.

4. An assembly according to claim 3 wherein said clip has two pairs of depending legs each pair of said legs having oppositely directed flanges and one leg of each of said pairs defining a socket to receive a wire connection portion.

5. A terminal assembly comprising first and second electrical terminal fittings having a unitary construction adapted for mutual contact, each terminal fitting including planar superposing members lying over each other in use, a terminal portion having a fixing aperture with an axis extending generally perpendicular to said superposing members, said superposing members being on either side of said aperture, and a wire connection portion, the wire connection portions of adjacent terminal fittings being substantially in the plane of said superposing members and parallel, the assembly further comprising pressing structure to press the superposing members into contact with each other, the pressing member comprising a protrusion as a longitudinal rib formed in and projecting outward from one of the superposing members of said first terminal fitting for engagement with one of the superposing members of said second terminal fitting in the general direction of said axis of said aperture, the terminal fittings having sliding retention means to retain the terminal fittings together.

6. A terminal assembly comprising first and second electrical terminal fittings adapted for mutual contact, each terminal fitting including planar superposing members lying over each other in use, a terminal portion having a fixing aperture, said superposing members being on either side of said aperture, and a wire connection portion, the wire connection portions of adjacent terminal fittings being substantially in the plane of said superposing members and parallel, the assembly further comprising pressing structure to press the superposing members into contact with each other, the pressing member comprising a protrusion as an upstanding tongue sheared from one of the superposing members of said first terminal fitting for engagement with one of the superposing members of said second terminal fitting, the terminal fittings having sliding retention means to retain the fittings together.

7. A terminal assembly comprising first and second electrical terminal fittings adapted for mutual contact, each terminal fitting including planar superposing members lying over each other in use, a terminal portion having a fixing aperture, said superposing members being on either side of said aperture, and a wire connection portion, the wire connection portions of adjacent terminal fittings being substantially in the plane of said superposing members and parallel, the assembly further comprising pressing structure to press the superposing members into contact with each other, said pressing member comprising a removal preventing tongue of one of said terminal fittings and a socket adapted to receive said tongue, said tongue and socket having a mutually engageable latch and latch aperture, whereby said socket is resiliently deformable and presents an opening smaller than said tongue whereby, in use, said socket deforms an entry of said tongue therein to urge said terminal fittings into close engagement.

8. An assembly according to claim 7 wherein said socket is substantially 'U' shaped and said tongue is wedged into contact therewith by mutual contact of the superposing members of said first and second terminals.

* * * * *